United States Patent [19]

Rassmann et al.

[11] 4,280,733

[45] Jul. 28, 1981

[54] ASYMMETRIC MINERAL MINING PLOUGH

[75] Inventors: Christoph Rassmann, Lunen; Alois Hauschopp, Werne; Gunter Schwolow, Hattingan; Horst Huss, Essen, all of Fed. Rep. of Germany

[73] Assignee: Gewerkschaft Eisenhutte Westfalia, Lunen, Fed. Rep. of Germany

[21] Appl. No.: 99,815

[22] Filed: Dec. 3, 1979

[30] Foreign Application Priority Data

Dec. 2, 1978 [DE] Fed. Rep. of Germany ..... 2852241

[51] Int. Cl.[3] ..... E21C 27/34

[52] U.S. Cl. ..... 299/34; 299/18

[58] Field of Search ..... 299/18, 32, 34

[56] References Cited

U.S. PATENT DOCUMENTS

| | | | |
|---|---|---|---|
| 4,035,025 | 7/1977 | Hermann et al. | 299/34 |
| 4,178,040 | 12/1979 | Merten | 299/34 |
| 4,189,187 | 2/1980 | Rassmann et al. | 299/34 |

*Primary Examiner*—Ernest R. Purser

*Attorney, Agent, or Firm*—Sughrue, Mion, Zinn, Macpeak and Seas

[57] ABSTRACT

A mineral mining plough for use in asymmetric ploughing, and movable to and fro alongside a conveyor, has a plough body provided with cutter means at its two ends. A first cutter means is arranged to win material when the plough is on the uphill run (that is to say when the plough moves in the opposite direction as the conveyor). A second cutter means is arranged to win material when the plough is on the downhill run. The second cutter means is mounted on the plough body for vertical movement relative to the plough body. This enables the second cutter means to be swung out of its working position (on the downhill run) to lie in a rest position (on the uphill run) in which it is in the path of travel of the first cutter means. This vertical movement of the second cutter means results in a plough of shorter length than known asymmetric ploughs.

20 Claims, 3 Drawing Figures

ASYMMETRIC MINERAL MINING PLOUGH

BACKGROUND OF THE INVENTION

This invention relates to a mineral mining plough for winning material in a mineral mining working. The invention is particularly concerned with a plough for winning different amounts of material on the "uphill" and "downhill" runs, that is to say, a plough utilising the method of asymmetrical ploughing. Throughout this specification, the term "uphill" run should be taken to mean the ploughing run whose direction is opposed to that of the conveyor along which the plough moves, and the term "downhill" run should be taken to mean the ploughing run whose direction is the same as that of the conveyor.

Asymmetrical ploughing has been well known since it was realised that, because of better ploughing techniques on the downhill run, a coal plough can win considerably more coal than the conveyor is capable of removing. Obviously, this depends on the consistency of the coal and other operating conditions. The conveyor can remove only a comparatively small amount of coal on the downhill run because the conveyor and the plough move in the same direction (with identical speeds the conveyor will be completely overloaded at one point, because the downhill moving coal stream would always be discharged at the same place onto the conveyor). The obvious way of getting round this problem is to increase the plough speed to such an extent that it exceeds the speed of the conveyor and so leads to a more favourable loading of the conveyor. Even then, however, it is not possible, during the downhill run, to utilise the optimum depth of cut of the coal plough. On the other hand, on the uphill run, it is possible for the plough to utilise the optimum depth of cut. This is because the plough and conveyor have a very high relative speed (the conveyor moving in the opposite direction to the plough). The consequence of this is that coal, which theoretically could be mined, is abandoned solely because the conveyor is not capable of removing this coal on the downhill run.

A mineral winning plough has been proposed having a first set of cutters arranged to win material lying a first height range, and a second set of cutters arranged to win material lying in a second height range. The plough is driven on the downhill run with the cutters so positioned that material is won to a greater depth over the first height range than over the second height range. The plough is then driven on the uphill run with the cutters so positioned that material is won to a smaller depth over the first height range than over the second height range.

With the plough, it is possible so to work a coal face to the correct profile that not only is the conveyor substantially uniformly loaded, but also the plough drive can be operated using substantially the same power during both uphill and downhill runs. In order to equalise the power requirements for the two runs, as well as to utilise as completely as possible the available drive capacity, the first set of cutters (which is pivotally mounted on the plough body for lateral movement into, and out of, its working position), is adjusted on the downhill run to a depth of cut that is considerably greater than that of the other cutters effective on the downhill run. For example, the first set of cutters may be adjusted to have the same depth of cut on the downhill run as the second (main) set of cutters on the uphill run. Usually, the first set of cutters are floor cutters so that a stress-relief cut is made at floor level on the downhill run, the stress relief cut facilitating the winning of coal in the subsequent uphill run.

The disadvantage of this plough is its length which results from the lateral pivoting of the first set of cutters, prevents the plough winning material at the ends of its two runs. The aim of the invention is, therefore, to provide an efficient plough of the shortest possible length which is suitable for asymmetrical ploughing.

SUMMARY OF THE INVENTION

The present invention provides a mineral mining plough for winning material in a mineral mining working, the plough being movable to and fro alongside a conveyor and having a plough body provided with first cutter means for winning material when the plough is on the uphill run and second cutter means for winning material when the plough is on the downhill run, wherein the second cutter means is mounted on the plough body for vertical movement relative to the plough body so that the second cutter means is movable into the path of travel of the first cutter means when the plough is on the uphill run.

Advantageously, the first cutter means is provided at one end of the plough body, and the second cutter means is provided at the other end of the plough body. Preferably, the second cutter means is positioned at the base of the plough body when the plough is on the downhill run. Thus, the second cutter means works the lower portion of a mineral seam when the plough is on the downhill run.

As the second cutter means can be moved vertically (preferably upwards from its working position on the downhill run) into a rest position when the plough is on the uphill run, in which rest position the second cutter means lies in (and follows) the path of travel of the first cutter means, the plough does not have to be excessively long. Moreover, by appropriate arrangements of the depths of cut of the cutter means and the seam heights which they cut, it is possible to ensure that the drive capacity of the plough is used as efficiently as possible on both runs.

The second cutter means may include a first set of cutters mounted on a rocker arm which is pivotally mounted, for vertical movement, on the plough body by means of two links. Advantageously, at least one of the links has a curved end face which pivotally engages within a complementarily-shaped recess in the rocker bar. This prevents the pivotal connection(s) between the link(s) and the rocker arm being blocked by fine coal dust or other similar material.

A further set of cutters may be provided on the rocker bar adjacent to the link which is remote from the first set of cutters, the further set of cutters forming part of the second cutter means. This further set of cutters may include a floor cutter. Advantageously, the plough body is provided with a further floor cutter positioned between said link and the first cutter means. Preferably, the lowest position of the rocker bar is determined by a vertically adjustable stop.

Advantageously, the first cutter means is constituted by second and third sets of cutters, the second set of cutters being positioned above the third set of cutters. Preferably, the second set of cutters is arranged on a first carrier which is pivotally mounted on the plough body for pivotal movement about an axis which lies in a plane parallel to that of the face being won and which is inclined at an acute angle to the vertical. Similarly, the third set of cutters may be arranged on a second carrier which is pivotally mounted on the plough body for pivotal movement about an axis which lies in a plane parallel to that of the face being won and which is inclined at an acute angle to the vertical. The third set of cutters may also be provided with a floor cutter which counteracts any tendency the plough may have to climb. This floor cutter may have a relatively short cutting depth which offers the possibility of having a short-cutting-depth floor cutter included in the first set of cutters. Such short-cutting-depth floor cutters are not subject to such high stresses as normal floor cutters which have larger cutting depths.

The plough may be provided with a fourth set of cutters, the first set of cutters being positioned beneath the fourth set of cutters when the plough is on the downhill run. Advantageously, the fourth set of cutters is arranged on a third carrier which is pivotally mounted on the plough body for pivotal movement about an axis which lies in a plane parallel to that of the face being won and which is inclined at an acute angle to the vertical. This fourth set of cutters is intended primarily for providing a stable hole at that end of the face occupied by the plough at the end of the downhill run (in cases where the plough cannot move into the gallery at the end of the face). This is necessary, because the first cutter means provided at the other end of the plough cannot reach the end portion of the seam unless the plough can move right into the gallery. Additionally, however, the fourth set of cutters can be used to make a slight stress-relieving cut in the middle and upper seam portions on the downhill run, which helps to relieve the load on the cutters at these levels on the uphill run.

Preferably, the first and third carriers are joined together by means of a tie bar for conjoint pivotal movement.

Advantageously, the second cutter means and the second set of cutters are arranged to have the same depth of cut, and the fourth set of cutters is arranged to have a depth of cut which is less than that of the second cutter means and the second set of cutters. Also, the upper cutters of the third set may have the same depth of cut as the second cutter means and the second set of cutters. This means that the first and further sets of cutters need only be lifted to the level of the upper cutters of the third set during the uphill run. Thus, by adjusting the proportion of the seam height won by the various sets of cutters, the loads on the plough on the two runs can be made approximately the same, so that the drive capacity of the plough is efficiently used on both runs.

BRIEF DESCRIPTION OF DRAWINGS

One form of plough constructed in accordance with the invention will now be described, by way of example, with reference to the accompanying drawings, in which.

DESCRIPTION OF PREFERRED EMBODIMENT

Figure 2:
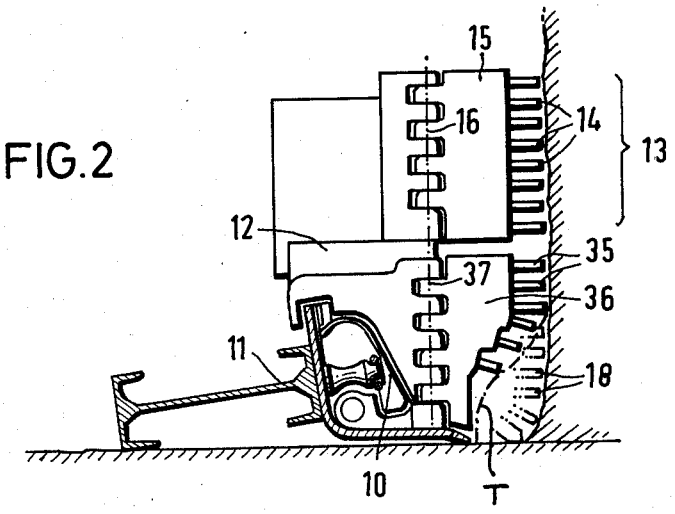
FIG. 2 is an end elevation of the plough looking in the direction of the arrow II shown in FIG. 1.

Referring to the drawings, FIG. 2 shows a guide 10 for the plough, the guide taking the form of an inclined ramp-like guide surface which is attached to the face-side of a scraper-chain conveyor 11. The guide 10 houses the usual ducts for an endless plough drive chain (not shown), the plough being connected to the lower (pulling) run of the drive chain in the usual manner.

Figure 1:
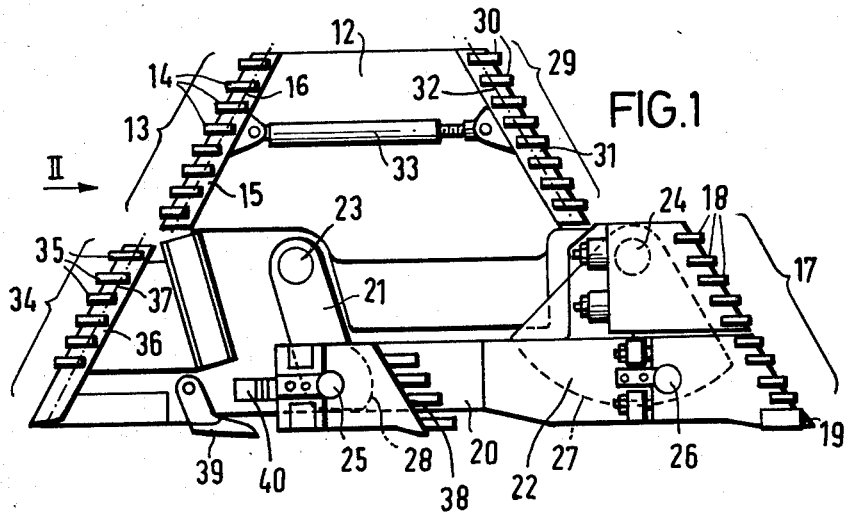
FIG. 1 is a view of the plough from the coal face.

The plough has a plough body 12 which is shaped to engage and slide on the guide 10. The direction of the downhill run is shown in FIG. 1 by the arrow II. The leading edge of the plough body 12 on the uphill run is provided with a main set 13 of cutters 14 which are arranged in an echelon formation one above the other. The cutters 14 are removably mounted in holders fixed to a carrier 15. The carrier 15 is pivotally attached to the plough body 12 for pivotal movement about an axis 16 which is situated in a plane parallel to the face and which is inclined at an acute angle to the vertical. Consequently, the set 13 can be swung into, and out of, a working position in which the cutters 14 win coal to a predetermined depth. The cutters 14 of the main set 13 work the middle and upper portions of the face when the plough is on the uphill run.

The plough is also provided with an auxiliary set 17 of cutters 18, these auxiliary cutters being operative during the downhill run. The cutters 18 are arranged in echelon formation one above the other on the end of a carrier 20 constituted by a rocker bar. The rocker bar 20 is also provided with a floor cutter 19 which, in known manner, controls the cutting horizon of the plough. The rocker bar 20 is linked to the plough body 12 for vertical movement by two links 21 and 22. The links 21 and 22 are pivoted to the plough body 12 by means of horizontal pivot pins 23 and 24 respectively that extend at right-angles to the face. Similarly, the links 21 and 22 are pivoted to the rocker bar 20 by means of pivot pins 25 and 26 respectively. The rocker bar 20 is constituted by an elongate solid plate whose rear edge (that is to say the edge remote from the face) is provided with recesses 27 and 28 for receiving the links 22 and 21 respectively. The link 22 has the shape of a sector of a circle and the recess 27 is of complementary shape, as shown in dashed lines in FIG. 1. Similarly, the link 21 has an arcuate end face which mates with a complementarily shaped recess 28. These arcuate link/recess formations prevent the links being jammed with, for example, fine coal dust. Thus, any coal dust that settles in the gaps between the links 21 and 22 and their corresponding recesses 28 and 27 is removed by a wiping action as the rocker bar 20 is pivoted vertically.

The rocker bar 20 is also provided with a second set 38 of auxiliary cutters which are situated in the region of the link 21. An additional floor cutter 39 (or a group of floor cutters) is provided on the plough body 12 on that side of the link 21 remote from the link 22. The provision of the additional floor cutter(s) 39 enables the plough to set the required cutting depth for the downhill runs after each uphill run. The lowest position of the rocker bar 20 (and hence of the auxiliary cutters 18 and 38) is determined by means of a stop 40 is provided on the plough body 12. The position of the stop 40 is adjustable to vary the level of cut of the auxiliary and floor cutters 18,19 and 38 to accommodate different seam levels.

The plough body 12 is also provided with a further main set 29 of cutters 30 which are arranged in echelon formation one above the other. These cutters 30 may win coal in the middle and upper portions of the seam when the plough is on the downhill run. The cutters 30 are removably mounted in holders fixed to a carrier 31. The carrier 31 is pivotally attached to the plough body 12 for pivotal movement about an axis 32 which is situated in a plane parallel to the face and which is inclined at an acute angle to the vertical. The carrier 31 is linked to the carrier 15 of the other main set 13 of cutters 14 by a tie bar 33 so that, when one main set is swung into its working position, the other main set is swung back into its rest position, and vice versa.

Below the main set 13 of cutters 14, the plough body 12 is provided with a further auxiliary set 34 of cutters 35 which are arranged in echelon formation one above the other. These cutters 35 win coal in the lower portion of the seam when the plough is on the uphill run. As can be seen in FIG. 2, the upper cutters 35 of the auxiliary set 34 win material to the same depth as the cutters 14 of the main set 13. However, the lower cutters 35 of the auxiliary set are set further and further back from the face so that the set 34 wins material to varying depths as indicated by the dotted line T in FIG. 2. The cutters 35 are removably mounted in holders fixed to a carrier 36, the carrier being pivotally attached to the plough body 12 for pivotal movement about an axis 37 which is situated in a plane parallel to the face and which is inclined at an acute angle to the vertical. The auxiliary set 34 may also incorporate a floor cutter (not shown) which operates at the same level as the floor cutter 19.

Figure 3:
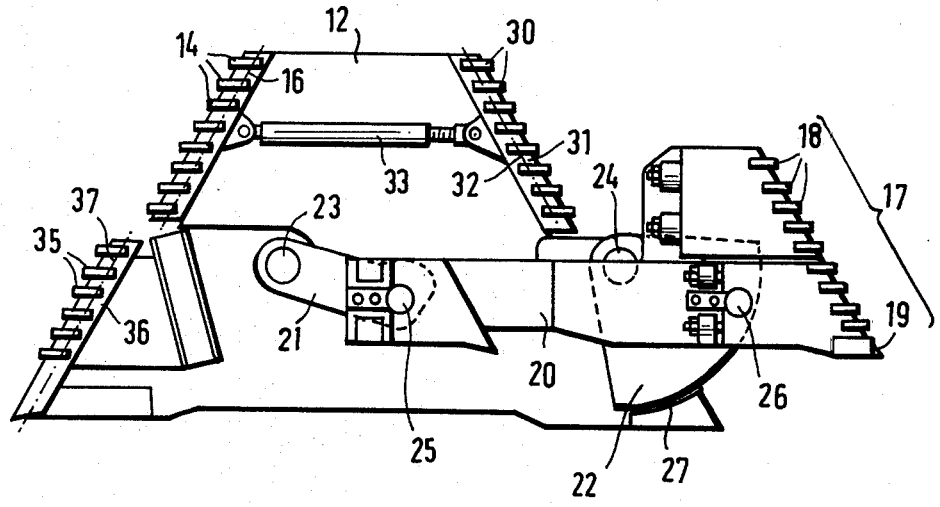
FIG. 3 is a view similar to that of FIG. 1, but showing the plough in a different operating condition.

FIG. 3 shows the position of the rocker bar 20 (and its associated cutters 18 and 19) when the plough is on the uphill run. As mentioned above, the main set 29 of cutters 30 is also in its rest position on the uphill run, having been swung back away from the face by the tie bar 33 as the other main set 13 of cutters is swung forward into its working position. Thus, when the plough is on the uphill run, coal is won in the middle and upper portions of the seam by the cutters 14 of the main set 13, and coal is won in the lower portion of the seam by the cutters 35 of the auxiliary set 34. Thus, after the plough has completed the uphill run, the face is shaped as shown by the contour of the dotted line T (see FIG. 2), in other words, coal is left only in the lower zone of the face. This remaining coal is then won on the following downhill run.

FIG. 1 shows the auxiliary set 17 in its working position, in which its cutters 18, 19 and 38 win the remaining coal from the lower portions of the seam during the subsequent downhill run. Then, after each downhill run, the face is substantially vertical, the plough having removed a cut of substantially constant thickness over the entire seam height during the uphill run and subsequent downhill run. At the end of the downhill run, the rocker bar 20 is swung upwardly to position the auxiliary set 17 in its rest position, in which the cutters 18, 19 and 38 lie at about the level of the upper cutters 35 of the set 34 and of the lower cutters 14 of the set 13. Thus, the upward swinging movement brings the cutters 18, 19 and 38 into the path of travel of the cutters 35 and 13 which have the greatest depth of cut, so that, during the next uphill run, the auxiliary cutters 18, 19 and 38 are not in action. During this upward swinging movement, the cutters 18, 19 and 38 slide along the vertical base of the coal seam. The rocker bar 20 can be moved by any known means such as a hydraulic ram (not shown) attached to the plough body 12. Alternatively, the rocker bar 20 can be moved by interaction with the plough drive chain. In this case, the plough drive chain (which has a certain dead motion relative to the plough body 12) is linked to a setting device in such a manner that, when the pulling direction of the drive chain reverses, the rocker bar 20 is automatically swung upwards before the plough starts to move on the uphill run.

In order that the plough can be used for asymmetric ploughing with generally uniform drive capacity on both runs, the depth of cut of the cutters of the auxiliary set 17 is arranged to be the same as that of the main set 13, and the upper cutters 35 of the auxiliary set 34. The cut made by the auxiliary set 17 is effected in two separate actions by the cutters 18 and 38 respectively. Firstly, the cutters 18 make a cut whose depth is about one half that of the entire set 17. Then, the cutters 38, which are suitably offset from the cutters 18, complete the required depth of cut of the set 17.

The cutters 30 of the set 29 are intended primarily for winning coal at the end of the downhill run, that is to say to provide a stable hole at the end of the face, when the plough cannot work the entire face by moving into the gallery. However, these cutters 30 would be used to make a slight stress-relieving cut in the middle and upper seam portions on the downhill run. This would help to relieve the load on the cutters 14 of the main set 13 when the plough is on the uphill run. If the plough can be moved into the gallery, or if a stable-hole is provided by other means, the set 29 of the cutters 30 can be dispensed with.

The plough described above is able to move at the same speed on both runs. If the plough speed is less than that of the conveyor, the depth of cut of the cutters 14 of the main set 13 (and hence of the cutters 18 and 38 of the auxiliary set 17) is arranged to lie in the range of from 10 centimeters to 25 centimeters. This enables the drive capacity of the plough to be utilised as efficiently as possible over the two runs.

Obviously, the plough described above could be modified in a number of way. Thus, instead of the upper cutters 18 of the auxiliary set 17, upper cutters could be provided on a separate carrier fitted to the link 22. In this case, by appropriate construction of the links 21 and 22, the upward movement of the rocker bar 20 is maximized, the uppermost position of the rocker bar being approximately level with the top of the main portion of the plough body 12 (that is to say the portion of the plough body which supports the carrier 15). The cutters 38 and 39 and the stop 40 are shown only in FIG. 1, being omitted from FIG. 3 for the sake of clarity.

We claim:

1. A mineral mining plough for winning material in a material mining working wherein the plough is movable to and fro alongside a conveyor, comprising: a plough body, first cutter means provided on said body for winning material when the plough is moved in a direction opposite to that of said conveyor, said first cutter means having a first predetermined path of travel, second cutter means provided on said body for winning material when the plough is moved in the same direction as said conveyor, said second cutter means having a second predetermined path of travel, and means for vertically moving said second cutter means relative to said body, whereby when said plough is moved in said direction opposite to that of said conveyor, said moving means are operable to vertically move said second cutter means into said first path of travel.

2. A plough according to claim 1, wherein the first cutter means is provided at one end of the plough body and the second cutter means is provided at the other end of the plough body.

3. A plough according to claim 1, wherein the second cutter means is positioned at the base of the plough body when the plough moves in said same direction as said conveyor.

4. A plough according to claim 1, wherein the second cutter means includes a first set of cutters mounted on a rocker arm which is pivotally mounted, for vertical movement, on the plough body by means of two links.

5. A plough according to claim 4, wherein at least one of the links has a curved end face which pivotally engages within a complementary-shaped recess in the rocker bar.

6. A plough according to claim 4, wherein a further set of cutters is provided on the rocker bar adjacent to the link which is remote from the first set of cutters, the further set of cutters forming part of the second cutter means.

7. A plough according to claim 6, wherein the further set of cutters includes a floor cutter.

8. A plough according to claim 7, wherein the plough body is provided with a further floor cutter positioned between said link and the first cutter means.

9. A plough according to claim 4, wherein the lowest position of the rocker bar is determined by a vertically adjustable stop.

10. A plough according to claim 4, wherein the first cutter means comprises second and third sets of cutters, the second set of cutters being positioned above the third set of cutters.

11. A plough according to claim 10, wherein the second set of cutters is arranged on a first carrier which is pivotally mounted on the plough body for pivotal movement about an axis which lies in a plane parallel to that of the face being won and which is inclined at an acute angle to the vertical.

12. A plough according to claim 11, wherein the third set of cutters is arranged on a second carrier which is pivotally mounted on the plough body for pivotal movement about an axis which lies in a plane parallel to that of the face being won and which is inclined at an acute angle to the vertical.

13. A plough according to claim 12, wherein a fourth set of cutters is provided, the first set of cutters being positioned beneath the fourth set of cutters when the plough moves in said same direction as said conveyor.

14. A plough according to claim 13, wherein the fourth set of cutters is arranged on a third carrier which is pivotally mounted on the plough body for pivotal movement about an axis which lies in a plane parallel to that of the face being won and which is inclined at an acute angle to the vertical.

15. A plough according to claim 14, wherein the first and third carriers are joined together by means of a tie bar for conjoint pivotal movement.

16. A plough according to claim 10, wherein the second cutter means and the second set of cutters are arranged to have the same depth of cut.

17. A plough according to claim 16, wherein a further set of cutters is provided on the rocker bar adjacent to the link which is remote from the first set of cutters, the further set of cutters forming part of the second cutter means.

18. A plough according to claim 17, wherein the first set of cutters and the further set of cutters each has a depth of cut which is one half that of the second cutter means, the further set of cutters being offset, with respect to the first set of cutters, towards the face to be won by a distance equal to half said depth of cut of the second cutter means.

19. A plough according to claim 16, wherein the upper cutters of the third set of cutters are arranged to have the same depth of cut as the second cutter means and the second set of cutters, and the lower cutters of the third set of cutters have a depth of cut which is less than that of the second cutter means and the second set of cutters.

20. A plough according to claim 13, wherein the first and second sets of cutters are arranged to have the same depth of cut and the fourth set of cutters is arranged to have a depth of cut which is less than that of first and second sets of cutters.

* * * * *